US009257215B2

(12) United States Patent
Wollitzer et al.

(10) Patent No.: US 9,257,215 B2
(45) **Date of Patent: *Feb. 9, 2016**

(54) STAR QUAD CABLE WITH SHIELD

(75) Inventors: Michael Wollitzer, Fridolfing (DE); Gunnar Armbrecht, Fridolfing (DE); Helmut Reiter, Fridolfing (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 162 days.

This patent is subject to a terminal disclaimer.

(21) Appl. No.: 14/007,541

(22) PCT Filed: Mar. 5, 2012

(86) PCT No.: PCT/EP2012/000981

§ 371 (c)(1),
(2), (4) Date: Sep. 25, 2013

(87) PCT Pub. No.: WO2012/139685

PCT Pub. Date: Oct. 18, 2012

(65) Prior Publication Data

US 2014/0014393 A1 Jan. 16, 2014

(30) Foreign Application Priority Data

Apr. 14, 2011 (DE) ..... 20 2011 005 273 U

(51) Int. Cl.

| | |
|---|---|
| ***H01B 11/04*** | (2006.01) |
| ***H01B 11/00*** | (2006.01) |
| ***H01B 11/10*** | (2006.01) |
| *H01B 7/18* | (2006.01) |

(52) U.S. Cl.

CPC ..... *H01B 11/04* (2013.01); *H01B 11/005* (2013.01); *H01B 11/1033* (2013.01); *H01B 7/18* (2013.01)

(58) Field of Classification Search

CPC ..... H01B 11/04
USPC ..... 174/113 R, 108, 109
See application file for complete search history.

(56) References Cited

U.S. PATENT DOCUMENTS

| | | | | |
|---|---|---|---|---|
| 5,444,184 | A * | 8/1995 | Hassel | 174/113 R |
| 7,291,786 | B2 * | 11/2007 | Matsui et al. | 174/113 R |
| 2005/0029006 | A1 * | 2/2005 | Takahashi et al. | H01B 11/005 174/102 R |
| 2010/0218970 | A1 * | 9/2010 | Eshima | 174/108 |

FOREIGN PATENT DOCUMENTS

| | | | |
|---|---|---|---|
| DE | 1725372 | U | 7/1956 |
| DE | 1019727 | B | 11/1957 |
| DE | 1490692 | A1 | 7/1969 |
| DE | 20016527 | U1 | 11/2000 |
| EP | 0567757 | A2 | 11/1993 |

* cited by examiner

*Primary Examiner* — Chau N Nguyen
(74) *Attorney, Agent, or Firm* — Robert Curcio; DeLio, Peterson & Curcio, LLC

(57) ABSTRACT

A star-quad cable for transmitting electrical signals with at least two pairs of electrical conductors, wherein each conductor has an electrically conductive core and a conductor sheath of an electrically insulating material which surrounds the core radially, the conductors being arranged at the corners of a square in a cross section of the star-quad cable, wherein the conductors of a pair are arranged at diagonally opposite corners of the square, and in each case the four conductors are twisted with one another in accordance with a star-quad arrangement with a predetermined stranding factor, wherein an electrically conducive shield surrounds the two pairs of conductors radially on the outside. An additional insulator sheath (of an electrically insulating material is arranged between the conductors and the shield.

9 Claims, 11 Drawing Sheets

STAR QUAD CABLE WITH SHIELD

BACKGROUND OF THE INVENTION

1. Field of the Invention

The present invention relates to a star-quad cable for transmitting electrical signals which has at least two pairs of electrical conductors, each conductor having a core made of an electrically conductive material and a conductor sheath made of an electrically insulating material which surrounds the core in a radial position, the conductors being arranged at the corners of a square in a cross-section of the star-quad cable, the conductors making up a pair being arranged at diagonally opposed corners of the square, four conductors at a time being twisted together in a star-quad arrangement with a predetermined lay factor, a shield made of an electrically conductive material which surrounds the two pairs of conductors on the outside radially being placed in position, and an additional insulator sheath made of an electrically insulating material being arranged between the conductors and the shield, the shield being constructed from a mesh of individual shield cores.

2. Description of Related Art

What is referred to as a "star-quad" is a lay-up term relating to conductors which have for example copper cores. Four conductors making up pairs of conductors are twisted together and then form two twin conductors which are laid up in a cruciform arrangement. Two conductors situated opposite one another form a pair, with respective electrical signals being transmitted on respective pairs. In other words the four conductors are arranged at the corners of a square in the cross-section of the star-quad, with the conductors making up a pair being arranged at diagonally opposed corners. The pairs of conductors thus lie perpendicular to one another and this produces a desired high damping of crosstalk from one pair to the other.

The star-quad cable is one of the symmetrical cables. In such cables, four conductors are twisted together in a cruciform arrangement. What this means is that the conductors situated in opposite positions form respective pairs of conductors. Because the pairs of conductors lie perpendicular to one another there is only a very low level of crosstalk. As well as the mechanical strengthening provided by the positioning of the conductors relative to one another, another advantage of the star-quad lay-up is its packing density, which is higher than with twisted pairs.

Because of the twist, the conductors, i.e. the individual cores, are longer than the cable itself. The so-called lay factor is the ratio of the length of an individual conductor to the length of the cable. In the case of telecommunications cables for example the lay factor is approximately 1.02 to 1.04. The lay factor correlates with a pitch or lead which is a result of the helical arrangement of the conductors which are twisted together. In the case of a thread, the pitch or lead specifies an axial distance between two thread grooves.

Known from printed document DE 14 90 692 A1, which is the generic document, is a carrier frequency cable having a central laid-up member in the form of a star-quad. Four stranded cores insulated with polyethylene are twisted with a lay length, s, and are surrounded by polyethylene insulation. The polyethylene insulation is enclosed by a shielding mesh of copper wires. A PVC sheath is applied to the shielding mesh.

SUMMARY OF THE INVENTION

The object underlying the invention is to improve a star-quad cable of the above-mentioned kind to the effect that the electrical properties of the cable are not adversely affected to any substantial degree either by ageing of the star-quad cable or by its being loaded with bending and torsional stresses when it is being laid.

The object is achieved in accordance with the invention by a star-quad cable of the above-mentioned kind which has the features described herein and in the claims.

The above and other objects, which will be apparent to those skilled in the art, are achieved in the present invention which is directed to a star-quad cable for transmitting electrical signals comprising: at least two pairs of electrical conductors, each conductor having a core made of an electrically conductive material and a conductor sheath made of an electrically insulating material which surrounds the core in a radial position, the conductors being arranged at the corners of a square in a cross-section of the star-quad cable, the conductors making up a pair being arranged at diagonally opposed corners of the square, four conductors at a time being twisted together in a star-quad arrangement with a predetermined lay factor; a shield including an electrically conductive material which surrounds the two pairs of conductors on the outside radially being placed in position, the shield being constructed from a mesh of individual shield cores; an insulator sheath including an electrically insulating material being arranged between the conductors and the shield; wherein at least one shield core, or at least one bundle of shield cores, are twisted to surround the conductors in a radial position such that at least one of the twisted shield cores or at least one of the bundles of shield cores extends substantially parallel to a respective core of a conductor in the axial direction, said at least one shield core or said at least one bundle of shield cores on the one hand and a respective core on the other hand extending in parallel to one another in the axial direction such that the at least one shield core or the at least one bundle of shield cores and the core lie on the same diagonal of the square at all points along the cross-section of the cable, and the at least one shield core or the at least one bundle of shield cores is arranged on a side of the core which is remote from the square.

The star-quad cable may include having the at least one shield core or the at least one bundles of shield cores twisted with a lay factor which corresponds to a lay factor of the conductors. The cores are preferably made of copper.

A second shield may be included which is conductively connected to the shield electrically is arranged on the shield outside it radially. The second shield may include a sheath or foil made of an electrically conductive material, or a mesh of individual second shield cores. The second shield cores may be twisted in the opposite direction to the cores of the shield, and may be twisted with a lay factor which corresponds to the lay factor of the cores of the shield.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
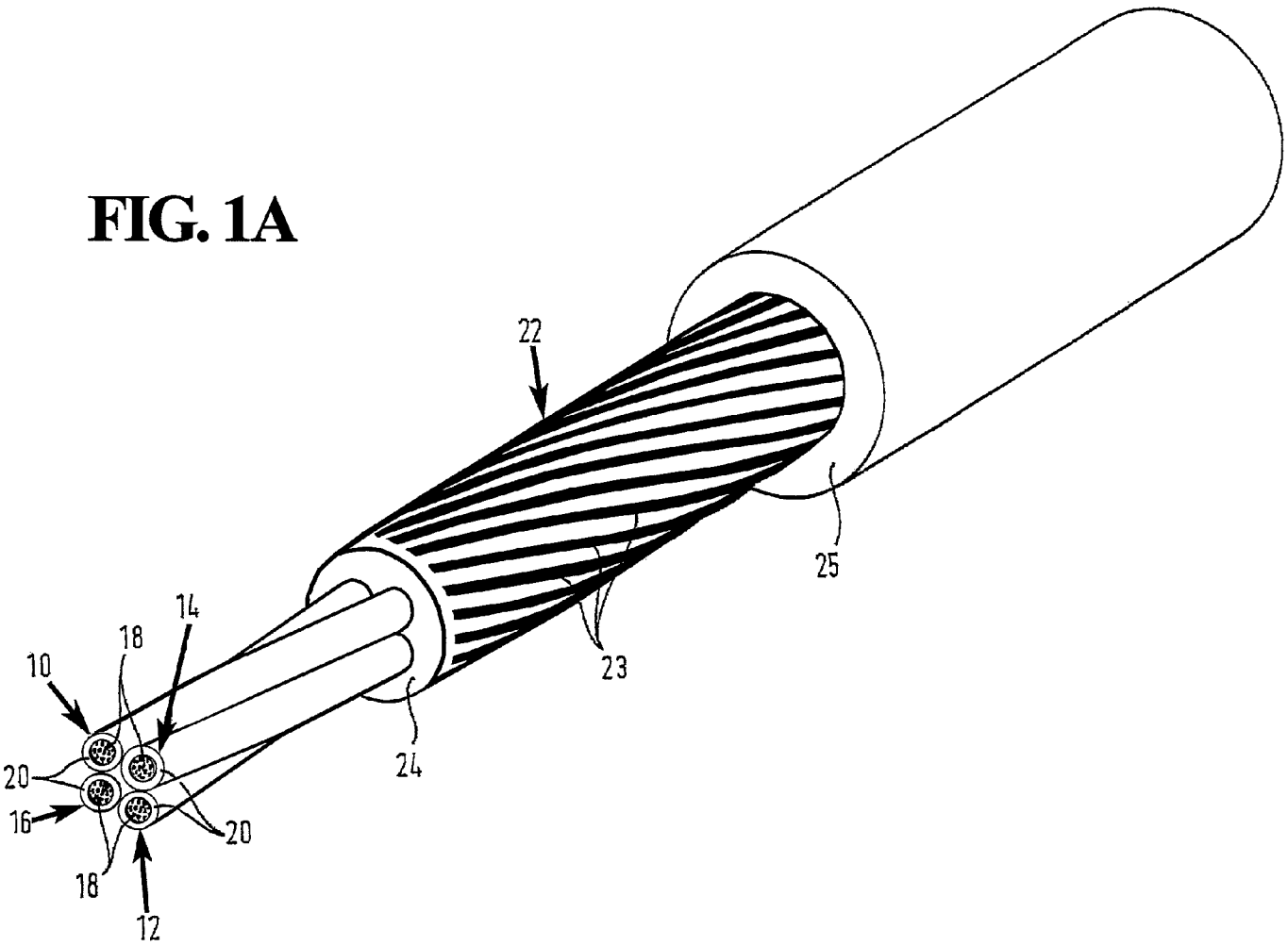
FIG. 1 is a perspective view of an illustrative embodiment of star-quad cable according to the invention.
FIG. 1B is a perspective view of an illustrative embodiment of the star-quad cable having a shield mesh according to the invention.
FIG. 1C is a perspective view of an illustrative embodiment of the star-quad cable having a second shield as a sheath or foil made of an electrically conductive material.
FIG. 1D is a perspective view of an illustrative embodiment of the star-quad cable having a second shield as a mesh made of an electrically conductive material.
FIG. 1E is a perspective view of an illustrative embodiment of the star-quad cable having second shield cores twisted in the opposite direction to the cores of the shield, in particular with a lay factor which corresponds to the lay factor of the cores of the shield.

In describing the preferred embodiment of the present invention, reference will be made herein to FIGS. 1-7 of the drawings in which like numerals refer to like features of the invention.

In a star-quad cable of the above-mentioned kind, provision is made in accordance with the invention for at least one, and in particular four, shield cores or at least one, and in particular four, bundles of shield cores to be twisted to surround the conductors in a radial position in such a way that at least one of the twisted shield cores or at least one of the bundles of shield cores extends substantially parallel to a respective core of a conductor in the axial direction, a given shield core or bundle of shield cores on the one hand and a core on the other hand extending in parallel to one another in the axial direction in such a way that the shield core or bundle of shield cores and the core lie on the same diagonal of the square at all points along the cross-section of the star-quad cable and the shield core or bundle of shield cores is arranged on a side of the core which is remote from the square.

This has the advantage that shield currents are reduced and the star-quad cable thereby retains its transmission properties even when there are bending and torsional stresses which affect the shield mechanically. Any shift-in-position phenomena in the star-quad cable are avoided and the stripping of the insulation off the star-quad cable is simplified because there is less risk of the cores being damaged when an external insulating sheath is being cut open. In addition to this, the additional insulator sheath exerts a radial pre-loading on the sheaths of the core conductors, whereby the mechanical strength of the star-quad arrangement is increased under bending and torsional stresses. Also achieved is an improvement in the conduction of electrical shield currents and a corresponding improvement in the electrical properties of the star-quad cable, particularly good conduction of shield currents associated with respective cores being achieved at the same time.

High mechanical flexibility for the star-quad cable while the arrangement of the conductors relative to one another remains relatively unchanged even when there are bending and torsional stresses on the star-quad cable is achieved by constructing the shield from a mesh of individual shield cores.

A particularly reliable way of guiding the shield cores or the bundles of shield cores along a given core of a conductor in parallel therewith even when there are bending and torsional stresses on the star-quad cable is achieved by twisting the shield cores or the bundles of shield cores with a lay factor which corresponds to a lay factor of the conductors.

Good electrical conductivity with, at the same time, low manufacturing costs is achieved by making the cores of copper.

A further improvement in the characteristic transmission curve of the star-quad cable by making it possible for additional electrical compensating currents to flow in the shield is achieved by arranging on the shield, outside it radially, a second shield which is conductively connected to the shield electrically. There may be manufacturing tolerances which result in shield cores and the associated conductors not extending exactly parallel to one another and the compensating currents enable these tolerances to be compensated for.

Figure 1B:
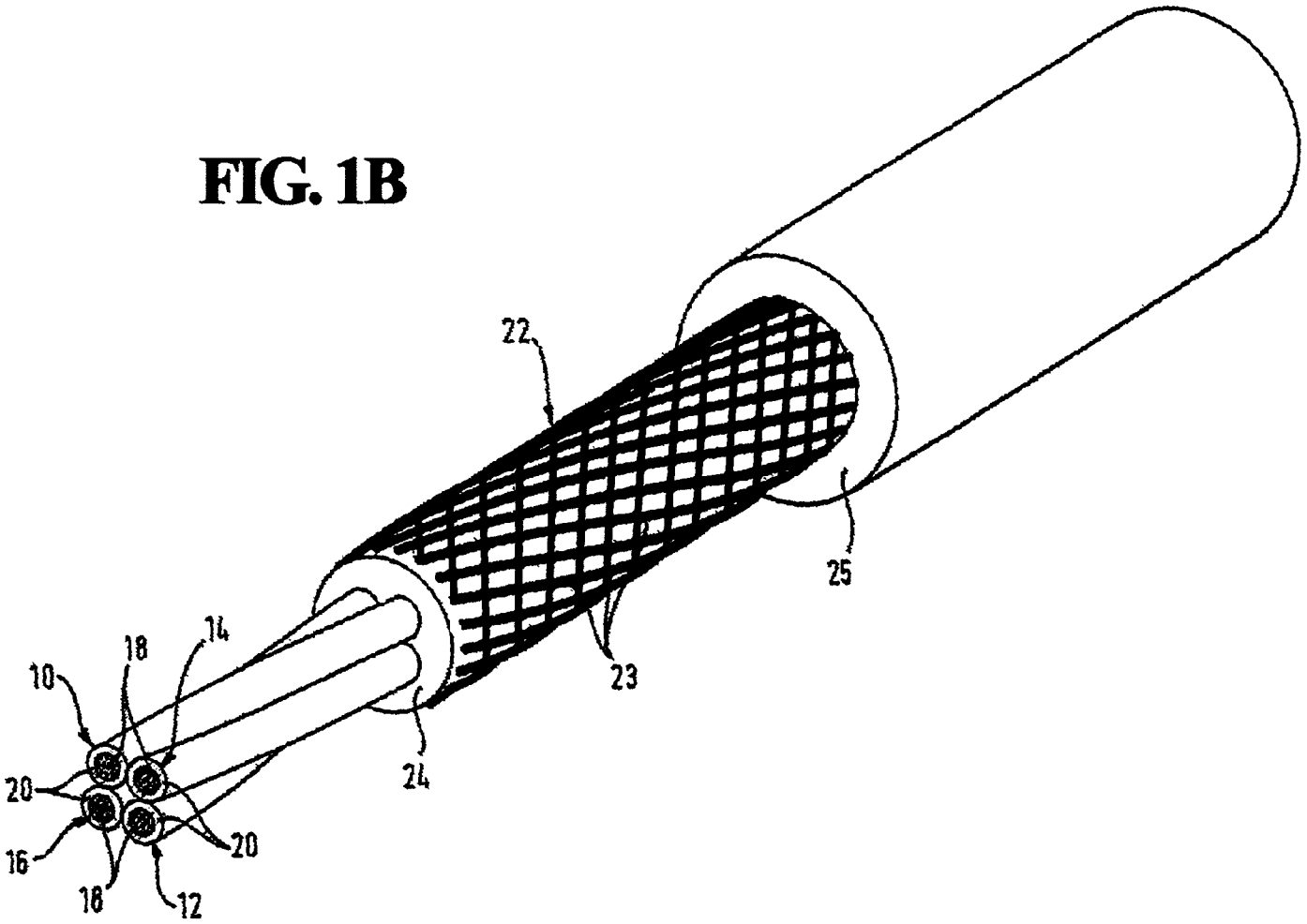
Figure 1C:
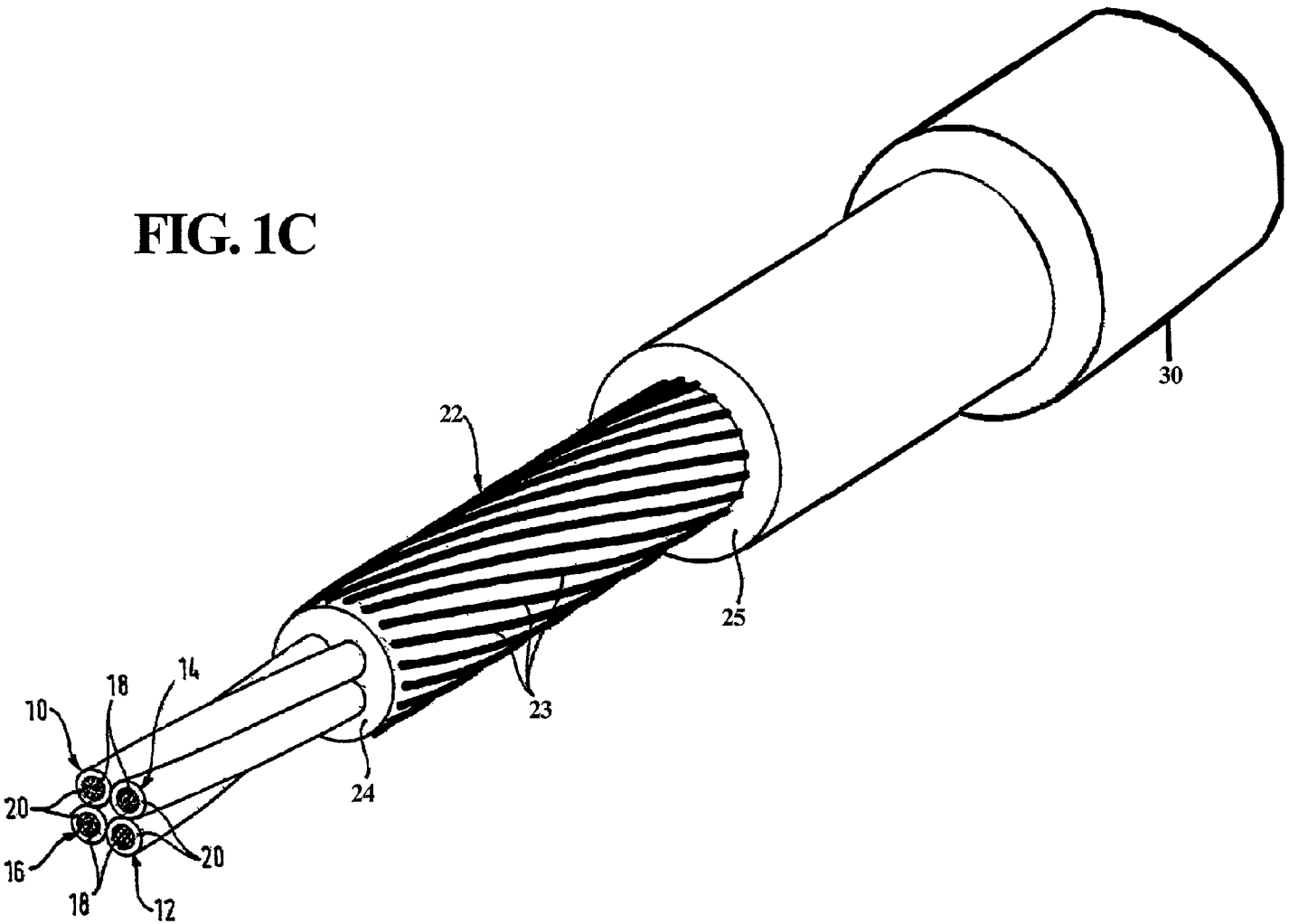

Conduction of compensating currents over a particularly large area of the second shield is achieved by forming the second shield 30 as a sheath or foil made of an electrically conductive material, as depicted in FIG. 1C.

Figure 1D:
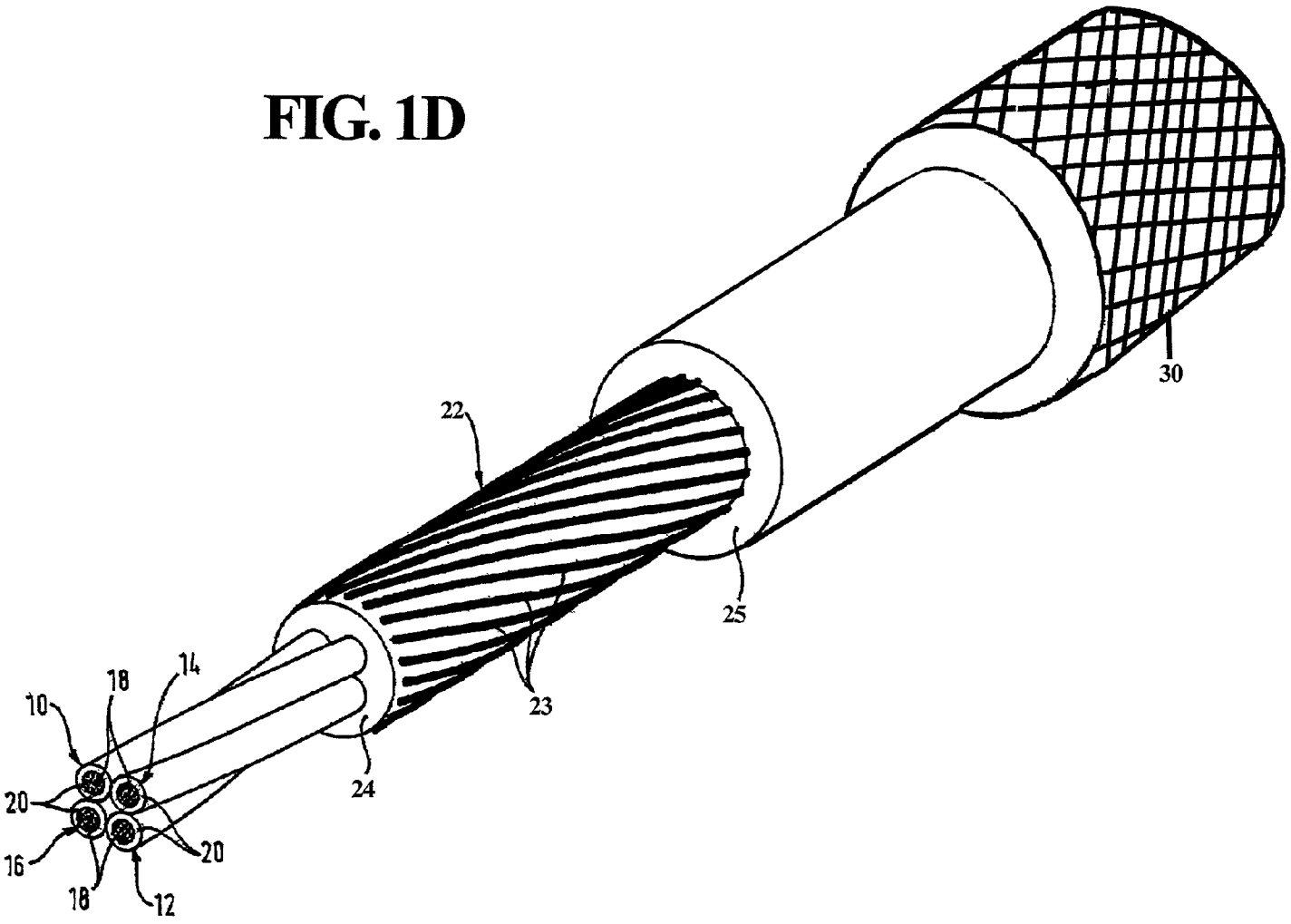

A particularly good way of enabling the star-quad cable to maintain its flexibility in spite of the second shield is achieved by constructing the second shield as a mesh of individual second shield cores, as depicted in FIG. 1D.

Figure 1E:
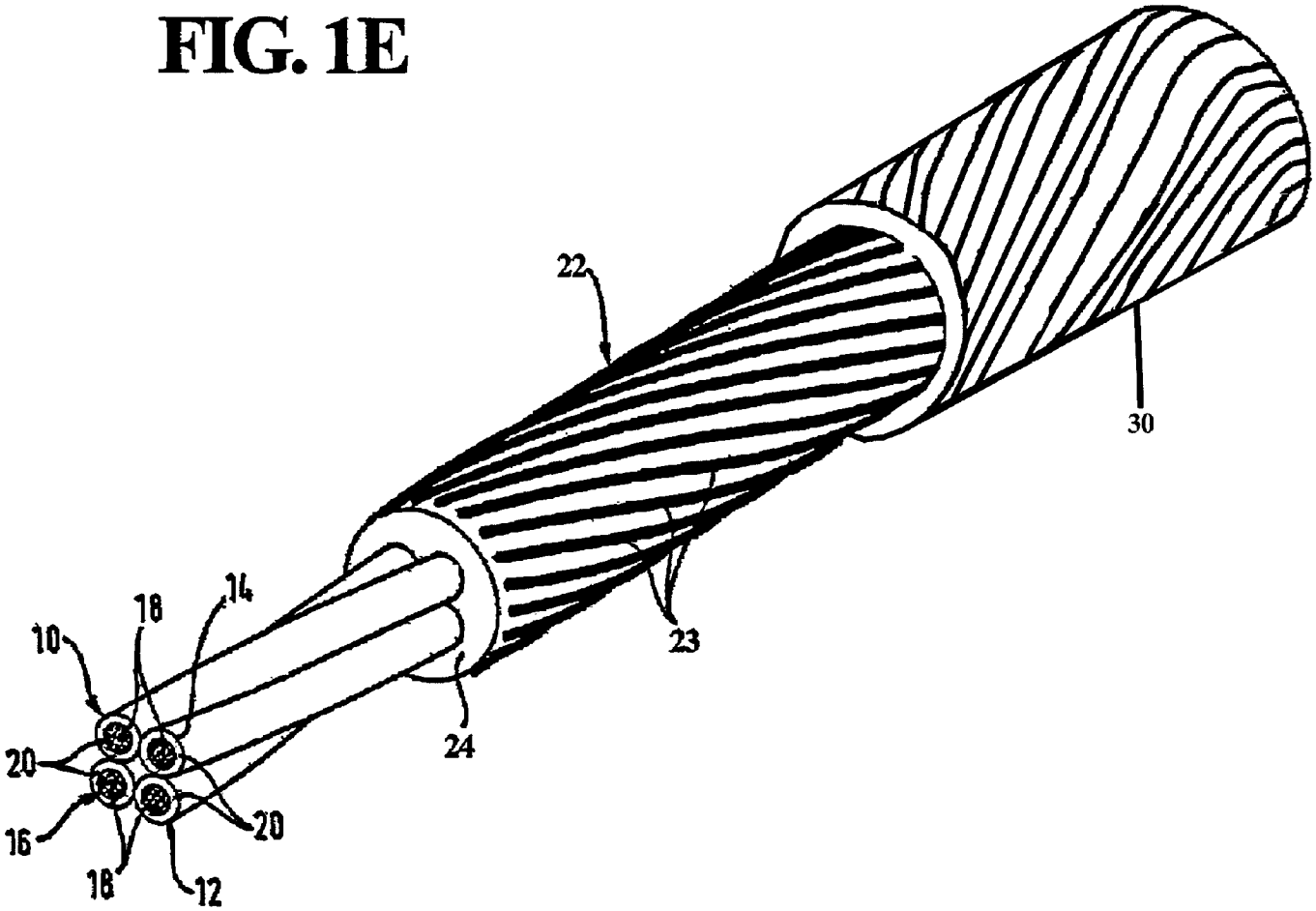

A large number of points of electrical contact between the second cores of the second shield and the cores of the shield situated inside it radially are obtained by twisting the second shield cores in the opposite direction to the cores of the shield, in particular with a lay factor which corresponds to the lay factor of the cores of the shield, as depicted in FIG. 1E.

Figure 2:
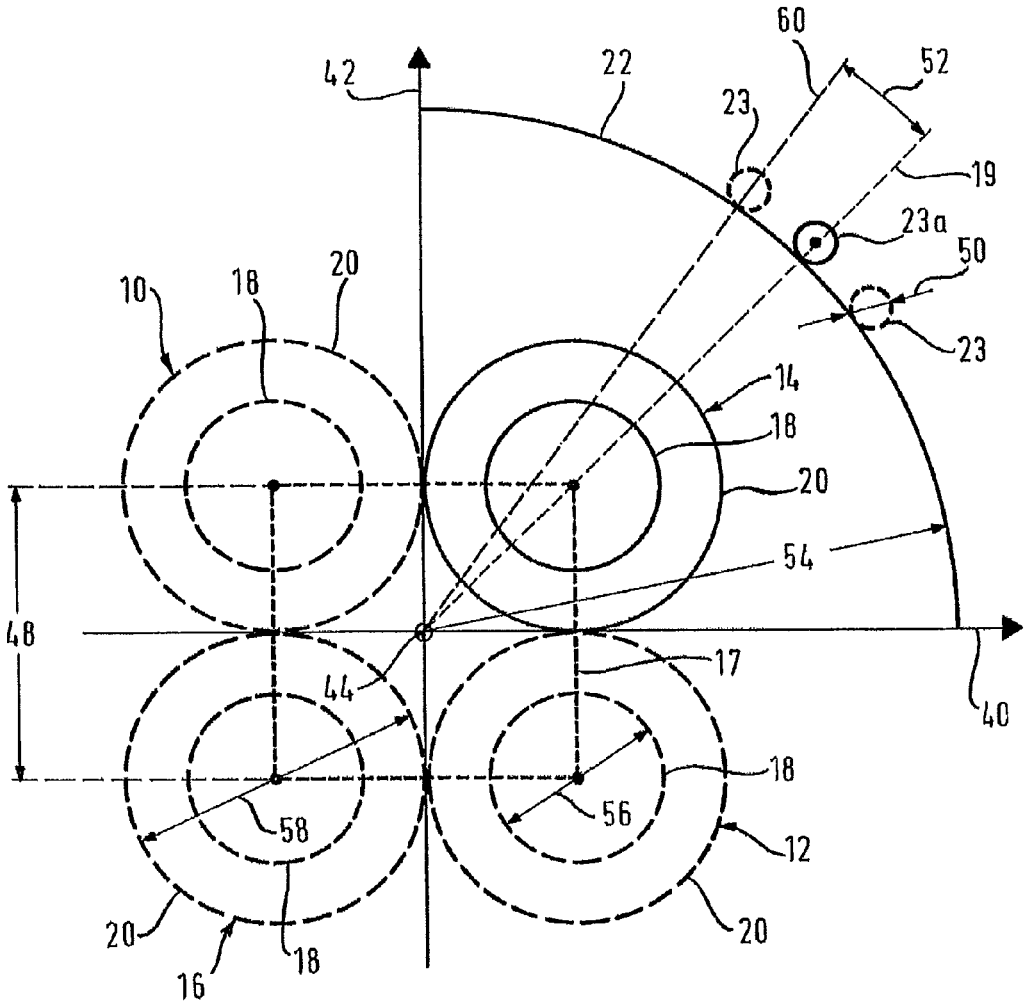
FIG. 2 is a schematic view in section of the star-quad cable shown in FIG. 1.

The preferred embodiment of star-quad cable according to the invention which is shown in FIGS. 1 and 2 comprises four conductors 10, 12, 14, 16 which each have a core 18 made of an electrically conductive material and a conductor sheath 20 made of an electrically insulating material. The conductors 10, 12, 14, 16 are twisted together in a star-quad layout, i.e. the conductors 10, 12, 14, 16 are situated at corners of a square 17 at any given point along the cross-section of the star-quad cable. Conductors 10, 12 and 14, 16 which situated opposite one another on respective diagonals 19 of the square 17 form pairs, i.e. the conductors 10, 12 form a first pair of conductors or a first conductor pair 12, 14 and the conductors 14, 16 form a second pair of conductors or a second conductor pair 14, 16. The twisting of the conductors 10, 12, 14, 16 is carried out with a given lay factor, which produces a corresponding pitch or lead or lay length s. In the present case the lay length s is that axial distance over which a conductor 10, 12, 14, 16 revolves completely around the longitudinal axis of the star-quad cable once in a helix. Shown in FIG. 2 is a co-ordinate system having an x-axis 40 and a y-axis 42. The co-ordinate system 40, 42 is so arranged that the origin 44 of the co-ordinate system 40, 42 lies exactly on the longitudinal axis of the star-quad cable, thus causing the said longitudinal axis to form a z direction in space for the co-ordinate system 40, 42.

In signal transmission, a first signal is transmitted by the first conductor pair 10, 12 and a second signal by the second conductor pair 14, 16. High damping of crosstalk between the two conductor pairs 10, 12 and 14, 16 is achieved in a known way by means of a resulting phase shift between the first and second signals and by means of the arrangement in space of the conductors 10, 12, 14, 16 relative to one another in a star-quad layout as described above. In what is referred to as a differential mode, the signals on the conductor pairs 10, 12 and 14, 16 have a phase shift of 180°.

Arranged to surround the twisted conductors 10, 12, 14, 16 on the outside radially is a shield 22 which is constructed from discrete, i.e. individual, shield cores 23. On the outside radially, a sheath 25 made of an electrically insulating material surrounds the entire assembly comprising the conductors 10, 12, 14, 16 and shield 22. There is arranged between the twisted conductor pairs 10, 12 and 14, 16 on the one hand and the shield 22 on the other hand an additional insulator sheath 24 made of an electrically insulating material. This latter creates an additional distance in space in the radial direction between the cores 18 of the conductors 10, 12, 14, 16 on the one hand and the shield 22 on the other hand. The effect thereby achieved will be explained in which follows by reference to FIGS. 3 and 4.

Figure 3:
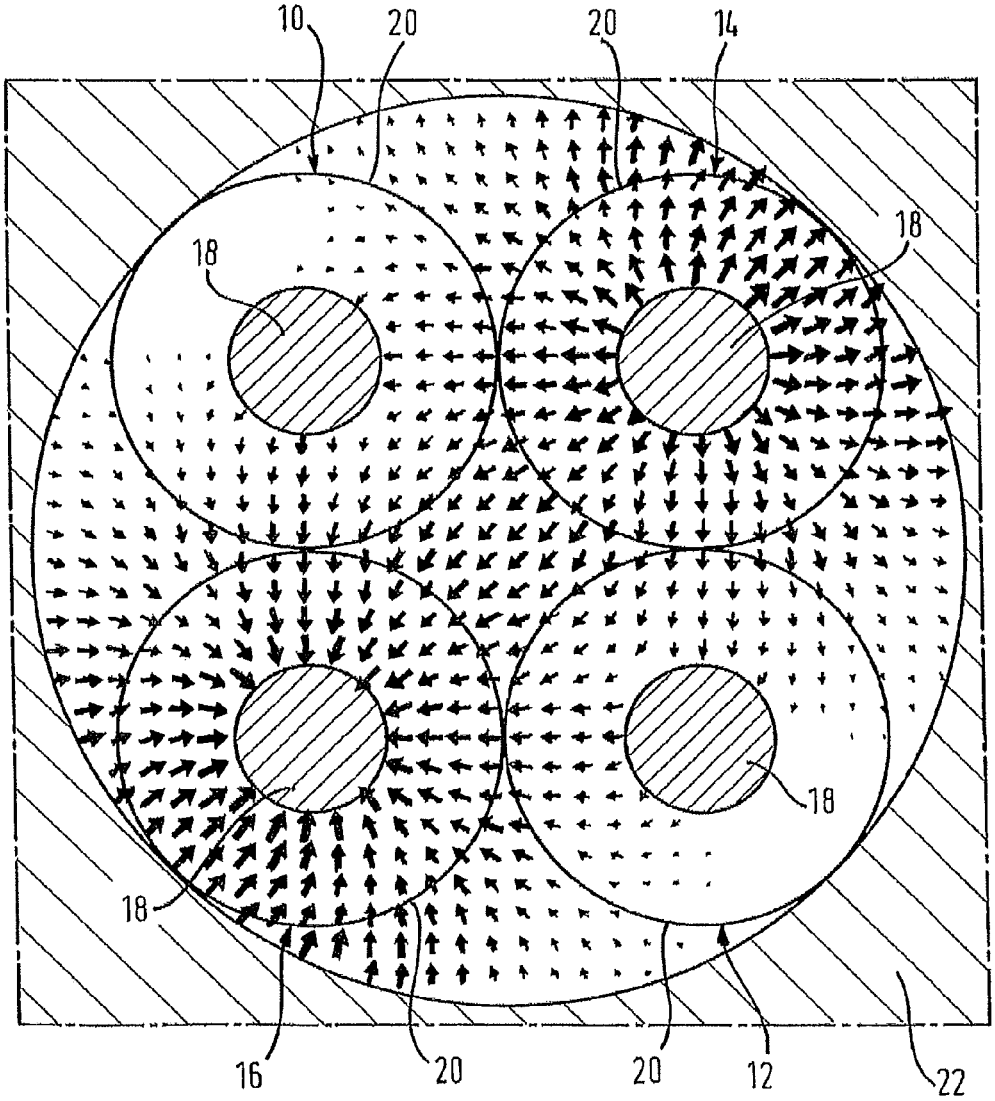
FIG. 3 is a schematic view in section of a conventional star-quad cable which includes a graphic representation of the distribution of an electrical field.

Shown in FIG. 3 is a schematic view in section of a conventional star-quad cable which has conductors 10, 12, 14, 16 having respective cores 18 and conductor sheaths 20 and which has a shield 22. On the outside radially, the shield 22 rests directly against the conductor sheaths 20 of the conductors 10, 12, 14, 16 in this case, thus producing a minimum distance radially between the cores 18 and the shield 22. Arrows show the distribution of an electrical field when appropriate electrical signals are transmitted along the conductors 10, 12, 14, 16, the electrical field being all the stronger the larger is the given arrow shown. It can be seen from FIG. 3 that a strong electrical field is set up between the cores 18 of the second conductor pair 14, 16 and the shield 22. This indicates that there are commensurately high electrical currents along the shield 22, which will be referred to for short in what follows as "shield currents". High shield currents result in all the factors which act on the shield 22 having a major effect on the electrical properties, i.e. the characteristic transmission curve, of the star-quad cable. In this way, bending and torsional stresses for example on the star-quad cable which result in deformation of the shield 22 or possibly even in damage thereto result is a severe degradation of the electrical properties, i.e. the characteristic transmission curve, of the star-quad cable, even though the cores 18 of the star-quad cable may possibly not be affected by mechanical changes or damage. Also, as depicted in FIG. 1B, the shield 22 is usually formed by a mesh of individual shield cores 23 and, in order to follow a core 18 for example, shield currents have to change over from one shield core 23 to another at points where shield cores 23 are in contact. If, in the course of time, these points of contact age, there is a corresponding obstacle to the flow of the shield currents and hence a corresponding degradation of the transmission of electrical currents by the entire star-quad cable even though no age-related mechanical degradation may have occurred in the cores 18 themselves.

Figure 4:
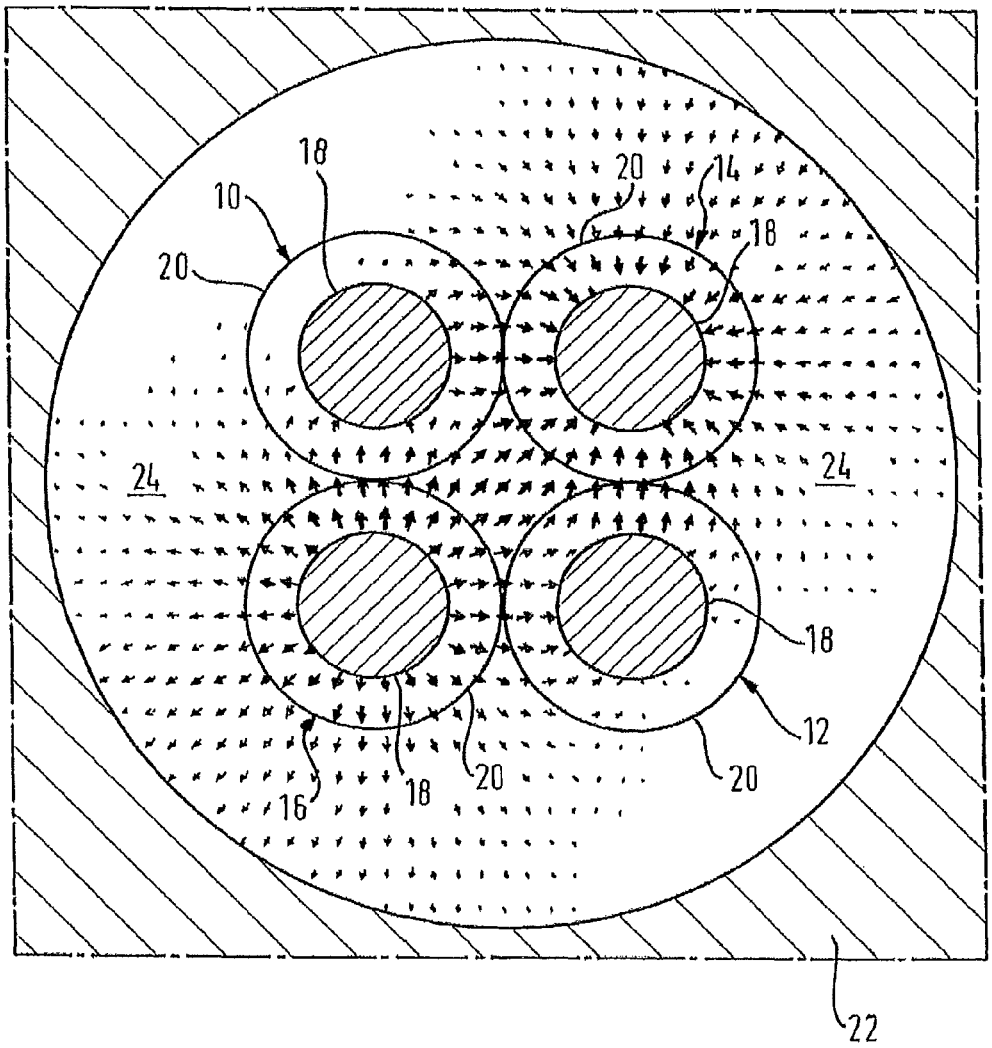
FIG. 4 is a schematic view in section of a star-quad cable according to the invention which includes a graphic representation of the distribution of an electrical field.

FIG. 4 is a view similar to FIG. 3 showing the distribution of the electrical field for a star-quad cable which is designed to have the additional insulator sheath 24. In this case, because of the additional insulator sheath 24 arranged between the conductors 10, 12, 14, 16 on the one hand and the shield 22 on the other hand, the shield 22 is at a greater distance radially from the cores 18 than in the conventional embodiment of star-quad cable shown in FIG. 3. It is apparent from FIG. 4 that the electrical field is now concentrated between the conductors 10, 12, 14, 16. This means that considerably fewer shield currents arise in a star-quad cable according to the invention when signals are being transmitted. This results in the effects due to a degradation of the shield 22 which were described above in relation to FIG. 3 thus having a smaller effect, in the star-quad cable according to the invention, on the electrical properties of the star-quad cable in respect of signal transmission. Degradation is for example an increase in attenuation for a useful signal in the star-quad cable. Even when the shield 22 is damaged or has aged, there is an appreciably lower adverse effect on the transmission properties of the star-quad cable. In other words, in respect of its transmission properties for electrical signals, the star-quad cable designed in accordance with the invention is considerably more resistant to damage or ageing of the shield 22.

Figure 5:
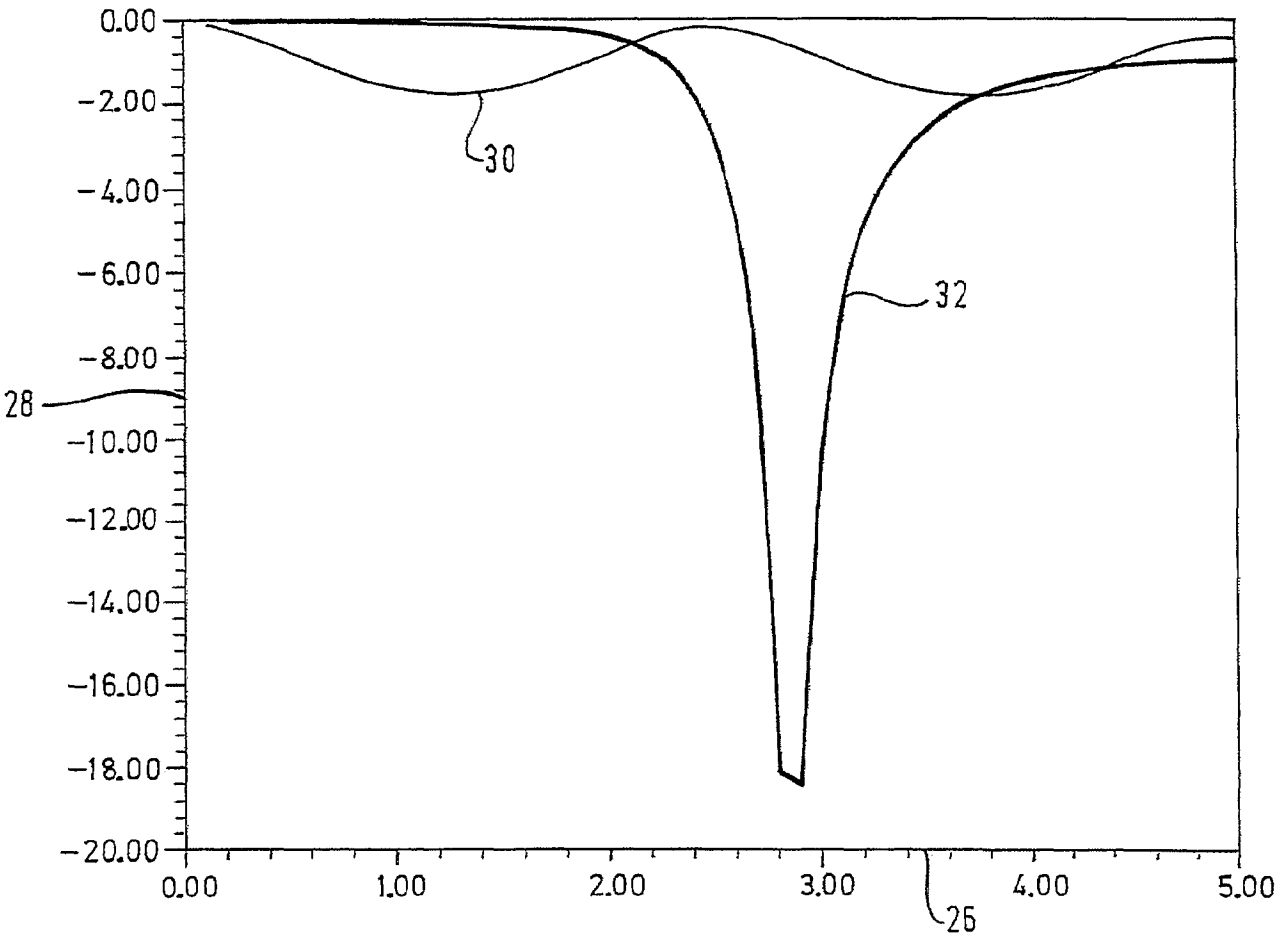
FIG. 5 is a graphic representation of the transmission of an electrical signal as a function of frequency for the conventional star-quad cable shown in FIG. 3.
Figure 6:
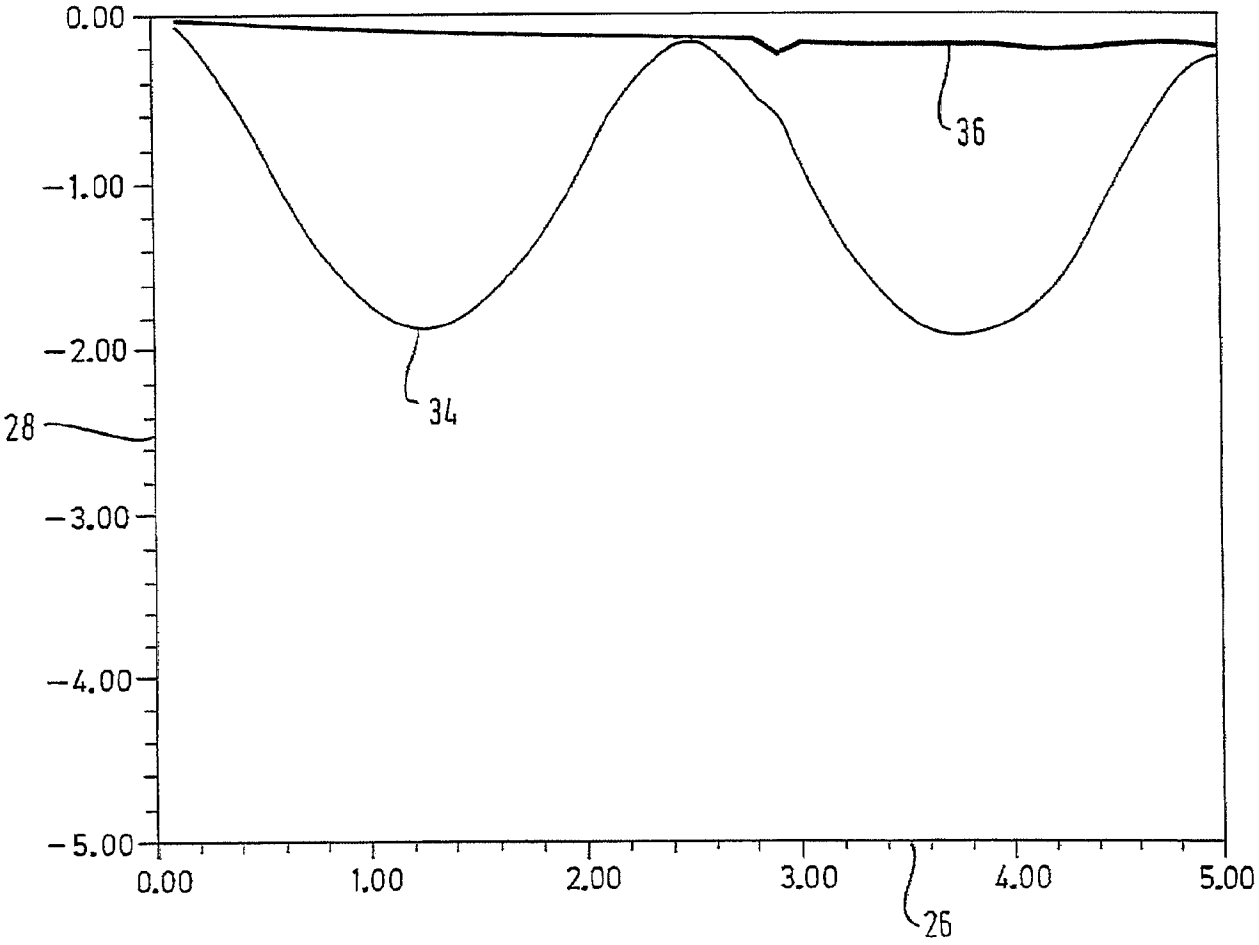
FIG. 6 is a graphic representation of the transmission of an electrical signal as a function of frequency for the star-quad cable according to the invention shown in FIG. 4.

In each of FIGS. 5 and 6, a frequency in GHz is plotted along a horizontal axis 26 and a transmission in dB for electrical signals along a vertical axis 28. A first curve 30, in FIG. 5, shows transmission 28 as a function of frequency 26 for common mode signal transmission (no phase shift between the signals on the conductor pairs 10, 12 and 14, 16), and a second curve 32, in FIG. 5, shows transmission 28 as a function of frequency 26 for differential mode signal transmission (a phase shift between the signals on the conductor pairs 10, 12 and 14, 16), in each case for a conventional star-quad cable as shown in FIG. 3. A third curve 34, in FIG. 6, shows transmission 28 as a function of frequency 26 for common mode signal transmission (no phase shift between the signals on the conductor pairs 10, 12 and 14, 16), and a fourth curve 36, in FIG. 6, shows transmission 28 as a function of frequency 26 for differential mode signal transmission (a phase shift between the signals on the conductor pairs 10, 12 and 14, 16), in each case for a star-quad cable according to the invention as shown in FIG. 4. Curves 30, 32, 34, 36 were obtained from respective simulations of the arrangements shown in FIGS. 3 and 4.

As can be seen from the second curve 32, in FIG. 5, in a conventional star-quad cable a dip in transmission occurs at around 2.9 GHz in differential mode transmission. As can be seen from the fourth curve, in FIG. 6, this dip no longer exists in a star-quad cable according to the invention. This result of a simulation is an impressive demonstration of the striking and unexpected improvement in the electrical properties of the star-quad cable according to the invention when transmitting electrical signals. In this case the improvement exists even before there is any damage to or ageing of the shield.

Figure 7:
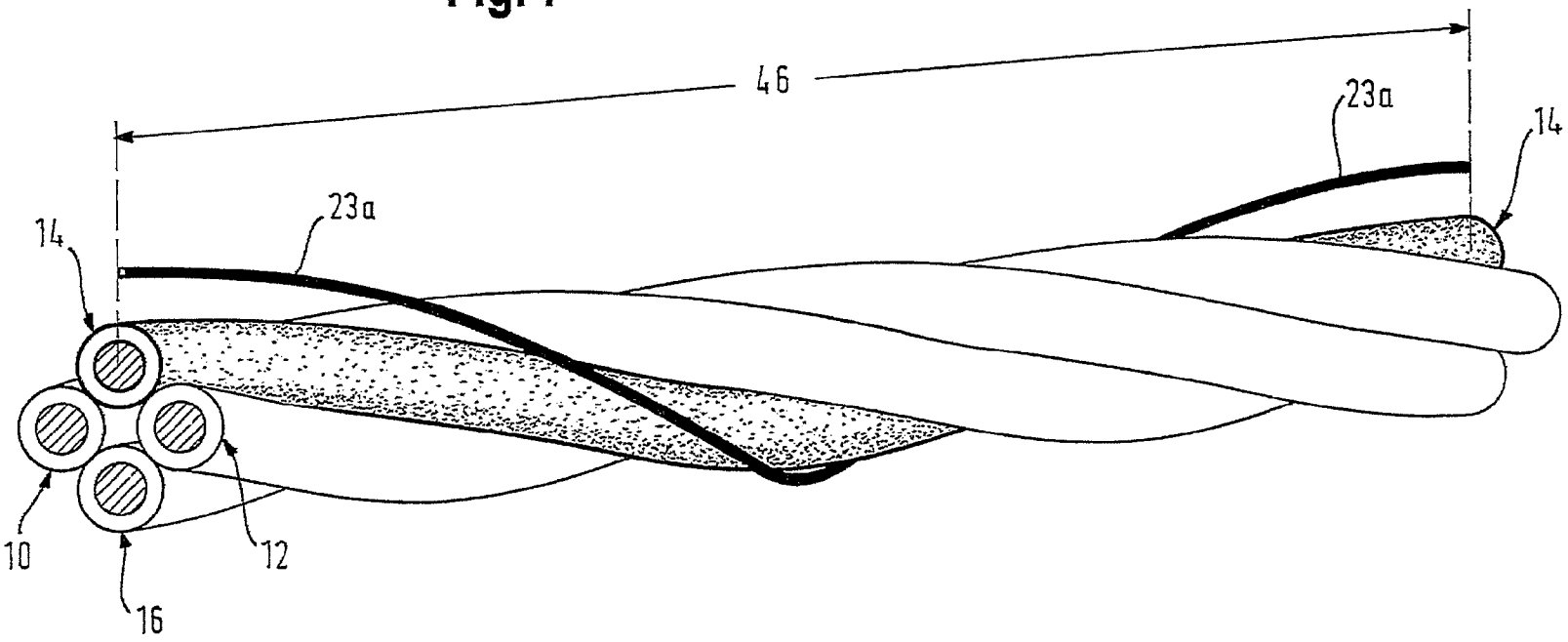
FIG. 7 is a simplified schematic representation of twisted-together conductors and a shield core of the illustrative embodiment of star-quad cable shown in FIGS. 1 and 2.

A further improvement in the electrical properties or transmission characteristics of the star-quad cable for electrical signals is achieved by having at least individual shield cores 23 follow respective ones of the conductors 10, 12, 14, 16 in parallel therewith. In other words, at least individual shield cores 23 are twisted with the same lay length s or the same lay factor as the conductors 10, 12, 14, 16. This is shown by way of example for a shield core 23*a* in FIG. 7. The lay length s 46 is also shown in FIG. 7. Due to the twisting, the shield core 23*a* revolves in a helix around the conductors 10, 12, 14, 16 in a radial position in such a way that the shield core 23*a* extends parallel to the conductor 14. The precise relative arrangement between the shield core 23*a* and the conductor 14 can be seen from FIG. 2. The shield core 23*a* revolves around the conductors 10, 12, 14, 16 in such a way that the conductor 14 and the shield core 23*a* are situated on a common diagonal at any point along the cross-section of the star-quad cable and the shield core 23*a* is arranged on a side of the conductor 14 which is remote from the square 17. Because the shield core 23*a* is positioned in this way, a shield current associated with the conductor 14 can follow the conductor 14 without there being any transition to another shield core 23*a*. The avoidance of transitions of the shield current from one shield core 23 to another improves the electrical conduction of the shield current along the shield 22 and thus makes an overall improvement in the electrical properties, i.e. the characteristic transmission curve, of the star-quad cable for the transmission of electrical signals. A particular result is for example lower attenuation of the useful electrical signal which is transmitted by the star-quad cable according to the invention.

The length, a, 48 of a side of the square 17 is for example 0.83 mm. This length, a, of a side corresponds to the distance between the centers of two adjacent conductors 10, 12, 14, 16. In the co-ordinate system 40, 42 having the longitudinal axis of the star-quad cable as the z direction, a position vector $\vec{\gamma}_{core,n}$ for the nth core where n=[1 . . . 4] is then, with a free parameter t=[0 . . . 1] for the z direction and over a lay length s, $$\vec{\gamma}_{Core,n} = \begin{pmatrix} \frac{a}{\sqrt{2}} \cdot \cos\left[(2\pi \cdot t) + (n-1) \cdot \frac{\pi}{2}\right] \\ \frac{a}{\sqrt{2}} \cdot \sin\left[(2\pi \cdot t) + (n-1) \cdot \frac{\pi}{2}\right] \\ s \cdot t \end{pmatrix}$$

In the co-ordinate system 40, 42 having the longitudinal axis of the star-quad cable as the z direction, a corresponding position vector $\vec{\gamma}_{Shield,n}$ for the $n_{Shield}$th core 23 or 23*a* is then, with a free parameter t=[0 . . . 1] for the z direction and over a lay length s, $$\vec{\gamma}_{n_{Shield}} = \begin{pmatrix} \frac{d_{Shield}}{2} \cdot \cos[(2\pi \cdot t) + (n_{Shield} - 1) \cdot \Delta\varphi] \\ \frac{d_{Shield}}{2} \cdot \sin[(2\pi \cdot t) + (n_{Shield} - 1) \cdot \Delta\varphi] \\ s \cdot t \end{pmatrix}$$

where $d_{Shield}$ is the diameter 50 of a shield core 23, 23*a*, where $n_{Shield}$=[1 . . . $N_{Shield}$] where $N_{Shield}$ is the total number of shield cores, and where $$\Delta\varphi = \frac{2\pi}{N_{Shield}}$$

is an angle 52 between the diagonal 19 on which the associated conductor (conductor 14 in the example shown) lies and a straight line 60, through the origin 44, on which the given shield core 23 lies. For shield core 23*a*, Δϕ=0° for example. Inserting $$\Delta\varphi = \frac{2\pi}{N_{Shield}}$$

gives $$\vec{\gamma}_{n_{Shield}} = \begin{pmatrix} \frac{d_{Shield}}{2} \cdot \cos\left(2\pi \cdot \left[t + \frac{n_{Shield} - t}{n_{Shield}}\right]\right) \\ \frac{d_{Shield}}{2} \cdot \sin\left(2\pi \cdot \left[t + \frac{n_{Shield} - t}{n_{Shield}}\right]\right) \\ s \cdot t \end{pmatrix}$$

Even though the shield core 23*a* is preferred for carrying the shield current associated with the conductor 14, this shield current from the conductor 14 may in necessary also be carried by one of the two shield cores 23 adjacent the shield core 23*a*. Hence, should the shield core 23*a* be damaged due to a bending or torsional stress, the shield current is nevertheless still able to flow through the shield along the shield cores 23*a* substantially parallel to the conductor 14 without having to make a change to a different shield core 23 as it does so.

The lay length s 46 is for example 40 mm. The radius 54 of the shield 22 is for example $r_{Shield}$=1.5 mm. The diameter 56 of a core 18 is for example $d_{Core}$=0.48 mm. The diameter 58 of a conductor sheath 20 is for example $d_{CoreInsul.}$=a=0.83 mm. The diameter 50 of a shield core 23, 23*a* is for example $d_{Shield}$=0.1 mm.

As an option, a second shield 30 made of an electrically conductive material may in addition be arranged on the shield 22 outside it radially. This second shield is thus conductively connected electrically, at its side situated on the inside radially, to the shield 22, electrical compensating currents thus being able to flow via the second shield. In this way, manufacturing tolerances which for example result in the shield core 23*a* not extending exactly parallel to the associated conductor 14 (FIG. 2) can, if required, be compensated for by means of the compensating currents. Ageing phenomena or damage to the shield 22 can also be compensated for in a similar way by means of the compensating currents flowing via the second shield.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A star-quad cable for transmitting electrical signals comprising:

at least two pairs of electrical conductors, each conductor having a core made of an electrically conductive material and a conductor sheath made of an electrically insulating material which surrounds the core in a radial position, the conductors being arranged at the corners of a square in a cross-section of the star-quad cable, the conductors making up a pair of said at least two pairs of electrical conductors being arranged at diagonally opposed corners of the square, said at least two pairs of electrical conductors being twisted together in a star-quad arrangement with a predetermined lay factor;

a shield including an electrically conductive material which surrounds the two pairs of conductors on the outside radially being placed in position, the shield being constructed from a mesh of individual shield cores, and a second shield which is conductively connected to the shield electrically is arranged on the shield outside radially, wherein the second shield includes a mesh of individual second shield cores that are twisted in the opposite direction to the cores of the shield with a lay factor which corresponds to a lay factor of the cores of the shield;

an insulator sheath including an electrically insulating material being arranged between the conductors and the shield;

wherein at least one of said shield cores, or at least one bundle of said shield cores, is twisted to surround the conductors in a radial position such that said at least one twisted shield core or said at least one twisted bundle of shield cores extends substantially parallel to respective core of said electrical conductors in the axial direction, said at least one twisted shield core or said at least one twisted bundle of shield cores and said respective core of said electrical conductors extending in parallel to one another in the axial direction such that the at least one twisted shield core or the at least one twisted bundle of shield cores and the respective core of said electrical conductors lie on the same diagonal of the square at all points along the cross-section of the cable, and the at least one twisted shield core or the at least one twisted bundle of shield cores is arranged on a side of the core of said electrical conductors and is remote from the square.

2. The star-quad cable of claim 1, having the at least one twisted shield core or the at least one twisted bundles of shield cores twisted with the lay factor which corresponds to the predetermined lay factor of the conductors.

3. The star-quad cable of claim 1 wherein the cores are made of copper.

4. The star-quad cable of claim 1 wherein said at least one twisted shield core includes four shield cores.

5. The star-quad cable of claim 4, having the at least one twisted shield core twisted with said predetermined lay factor of the conductors.

6. The star-quad cable of claim 5 wherein the cores are made of copper.

7. The star-quad cable of claim 1 wherein said at least one twisted bundle of shield cores includes four bundles of shield cores.

8. The star-quad cable of claim 7, having the at least one twisted bundle of shield cores twisted with said predetermined lay factor of the conductors.

9. The star-quad cable of claim 8 wherein the cores are made of copper.

* * * * *